US009670041B2

(12) United States Patent
Hoffman et al.

(10) Patent No.: US 9,670,041 B2
(45) Date of Patent: Jun. 6, 2017

(54) REMOTE ACTIVATION OF SCISSOR LIFT CYLINDER PROP

(71) Applicant: JLG Industries, Inc., Hagerstown, MD (US)

(72) Inventors: John Hoffman, McConnellsburg, PA (US); Brian Green, Mercersburg, PA (US); Troy Young, Mercersburg, PA (US); Jesse Sollers, Fayetteville, PA (US)

(73) Assignee: JLG INDUSTRIES, INC., Hagerstown, MD (US)

( * ) Notice: Subject to any disclaimer, the term of this patent is extended or adjusted under 35 U.S.C. 154(b) by 338 days.

(21) Appl. No.: 14/347,042

(22) PCT Filed: Oct. 17, 2012

(86) PCT No.: PCT/US2012/060548
§ 371 (c)(1),
(2) Date: Mar. 25, 2014

(87) PCT Pub. No.: WO2013/059271
PCT Pub. Date: Apr. 25, 2013

(65) Prior Publication Data

US 2014/0231733 A1 Aug. 21, 2014

Related U.S. Application Data

(60) Provisional application No. 61/547,884, filed on Oct. 17, 2011.

(51) Int. Cl.
*B66F 11/04* (2006.01)
*F15B 15/26* (2006.01)
(Continued)

(52) U.S. Cl.
CPC ..... *B66F 11/042* (2013.01); *F15B 15/261* (2013.01); *F15B 2015/267* (2013.01)

(58) Field of Classification Search
CPC ..... B66F 1/00; B66F 7/065; B66F 7/06691
(Continued)

(56) References Cited

U.S. PATENT DOCUMENTS 3,759,488 A * 9/1973 Lukas ..... B66F 3/30 254/8 R
3,796,282 A * 3/1974 Denier ..... E04G 1/22 108/145

(Continued)

FOREIGN PATENT DOCUMENTS

JP 57-155168 9/1982
WO WO 2006/112857 10/2006

OTHER PUBLICATIONS

Extended European Search Report dated Apr. 8, 2015 issued in European Patent Application No. 12841729.2, 8 pp.

(Continued)

*Primary Examiner* — Joseph J Hail
*Assistant Examiner* — J Stephen Taylor
(74) *Attorney, Agent, or Firm* — Nixon & Vanderhye P.C.

(57) ABSTRACT

A cylinder prop assembly is cooperable with a lift cylinder for a scissor lift and includes a cylinder prop displaceable between a disengaged position, in which the cylinder rod is movable relative to the cylinder housing, and an engaged position in which the cylinder rod is locked from displacement relative to the cylinder housing. An actuation lever is coupled with the cylinder prop and is accessible to displace the cylinder prop between the disengaged position and the engaged position.

4 Claims, 4 Drawing Sheets

(51) Int. Cl.
*F15B 20/00* (2006.01)
*E04G 1/22* (2006.01)

(58) Field of Classification Search
USPC ..... 254/15, 17, 423, 93 R, 93 VA, 93 L, 254/93 H, 122, 126
See application file for complete search history.

(56) References Cited

U.S. PATENT DOCUMENTS 4,027,737 A * 6/1977 Garry ..... B62D 31/02 180/11
4,106,641 A 8/1978 Campbell et al.
4,770,559 A * 9/1988 Yoo ..... E06C 1/32 182/163
4,899,987 A 2/1990 Craig
4,947,705 A * 8/1990 Yates ..... E02F 3/388 414/685
5,009,566 A * 4/1991 Asche ..... E02F 3/388 414/685
5,322,143 A * 6/1994 Curran ..... B66F 7/065 187/211
5,394,959 A 3/1995 Cullity et al.
5,836,232 A 11/1998 Williams
6,149,374 A * 11/2000 Dershem ..... E02F 9/24 212/292
6,688,797 B2 * 2/2004 Park ..... E06C 1/32 403/84
8,726,622 B2 * 5/2014 Wagner ..... F15B 15/261 267/64.12
2009/0273160 A1 11/2009 Friggstad et al.

OTHER PUBLICATIONS

International Search Report dated Jan. 3, 2013 issued in PCT International Patent Application No. PCT/US2012/060548, 1 pp.

* cited by examiner

REMOTE ACTIVATION OF SCISSOR LIFT CYLINDER PROP

This application is the U.S. national phase of International Application No. PCT/US2012/060548 filed 17 Oct. 2012 which designated the U.S. and claims priority to U.S. Provisional Application No. 61/547,884 filed 17 Oct. 2011, the entire contents of each of which are hereby incorporated by reference.

BACKGROUND OF THE INVENTION

The invention relates generally to scissor lifts and, more particularly, to a cylinder prop assembly suitable for use with a scissor lift.

Work platforms are utilized for a variety of different uses including loading and unloading of items in a warehouse and/or repairing components located at a particular elevation, such as repairing a broken ceiling light in a gymnasium. In a scissor lift, left and right side arm stacks are pinned together to define a scissor arm assembly and support a work platform. A lift cylinder acts to extend and retract the scissor arm assembly to raise and lower the platform via controls on the platform. The platform and scissor assembly are supported on a base portion including drive wheels that are also controllable with controls accessible on the platform.

Regular maintenance of the equipment often requires an operator to reach into and through the scissor arm assembly. For example, items requiring maintenance may include the lift cylinder itself, hydraulic hoses, electrical wires, scissor arms, etc. A potential hazard exists for the operator when reaching into or through the scissor assembly in the event that the operator inadvertently releases the hydraulic pressure in the lift cylinder causing the scissor assembly to retract. Previously, prop arms and the like have been installed between connecting pins in the scissor arm assembly to provide a mechanical lock against such retraction. The conventional structures, however, result in unequal loading of the scissor arm stack because the arms are only propped on one side, resulting in unnatural twisting of the whole unit and unnecessary stresses on the scissor structure.

SUMMARY OF THE INVENTION

It would be desirable for a cylinder prop assembly to safely prevent retraction of the scissor assembly during maintenance and the like while avoiding unequal loading of the scissor arm stack. The cylinder prop assembly of the described embodiments prevents retraction of the scissor arm lift cylinder to enable access inside the arms for inspection and routine maintenance. The assembly can be remotely activated and deactivated to maintain operator safety.

In an exemplary embodiment, a scissor lift includes a lift cylinder having a housing and a cylinder rod, where the cylinder rod is displaceable relative to the housing by hydraulic fluid. A scissor arm assembly is displaceable between a raised position and a lowered position by the lift cylinder, and a platform is supported by the scissor arm assembly. A cylinder prop assembly acts between the scissor arm assembly and the lift cylinder. The cylinder prop assembly includes a retaining plate secured to a distal end of the cylinder rod and pivotable relative to the cylinder rod, an actuation lever coupled with the retaining plate, and a cylinder prop coupled with the retaining plate and displaceable via the actuation lever between a disengaged position in which the cylinder rod is unlocked for displacement relative to the housing and an engaged position in which the cylinder rod is locked from displacement relative to the housing.

The scissor arm assembly may include a left side arm stack and a right side arm stack connected to each other across a middle area, where the cylinder prop assembly is disposed in the middle area. An end of the cylinder rod may include a bushing having an opening therein, where the cylinder prop includes an axle positioned in the opening and rotatable in the opening. The cylinder prop assembly may also include a locking mechanism cooperable with a hole in the bushing to lock the cylinder prop in the disengaged position.

In another exemplary embodiment, a cylinder prop assembly acts between a cylinder rod and a cylinder housing. In the cylinder prop assembly, a retaining plate is securable to a distal end of the cylinder rod and pivotable relative to the cylinder rod, and an actuation lever is coupled with the retaining plate. A cylinder prop is coupled with the retaining plate and displaceable via the actuation lever between a disengaged position in which the cylinder rod is unlocked for displacement relative to the housing and an engaged position in which the cylinder rod is locked from displacement relative to the housing.

The cylinder housing may define a shoulder relative to the cylinder rod, where in the engaged position, the cylinder prop is disposed adjacent the shoulder. A locking mechanism may be cooperable with the bushing to lock the cylinder prop in the disengaged position. Additionally, the locking mechanism may include a spring-loaded plunger engageable with a hole in the bushing. The spring-loaded plunger may be disposed through the retaining plate and connected to the actuation lever, where the actuation lever is pivotable relative to the retaining plate to retract the spring-loaded plunger.

In yet another exemplary embodiment, a cylinder prop assembly is cooperable with a lift cylinder for a scissor lift. The cylinder prop assembly includes a cylinder prop displaceable between a disengaged position in which the cylinder rod is movable relative to the cylinder housing and an engaged position in which the cylinder rod is locked from displacement relative to the cylinder housing. An actuation lever is coupled with the cylinder prop and is accessible to displace the cylinder prop between the disengaged position and the engaged position.

BRIEF DESCRIPTION OF THE DRAWINGS

These and other aspects and advantages will be described in detail with reference to the accompanying drawings, in which.

DETAILED DESCRIPTION OF THE DRAWINGS

Figure 1:
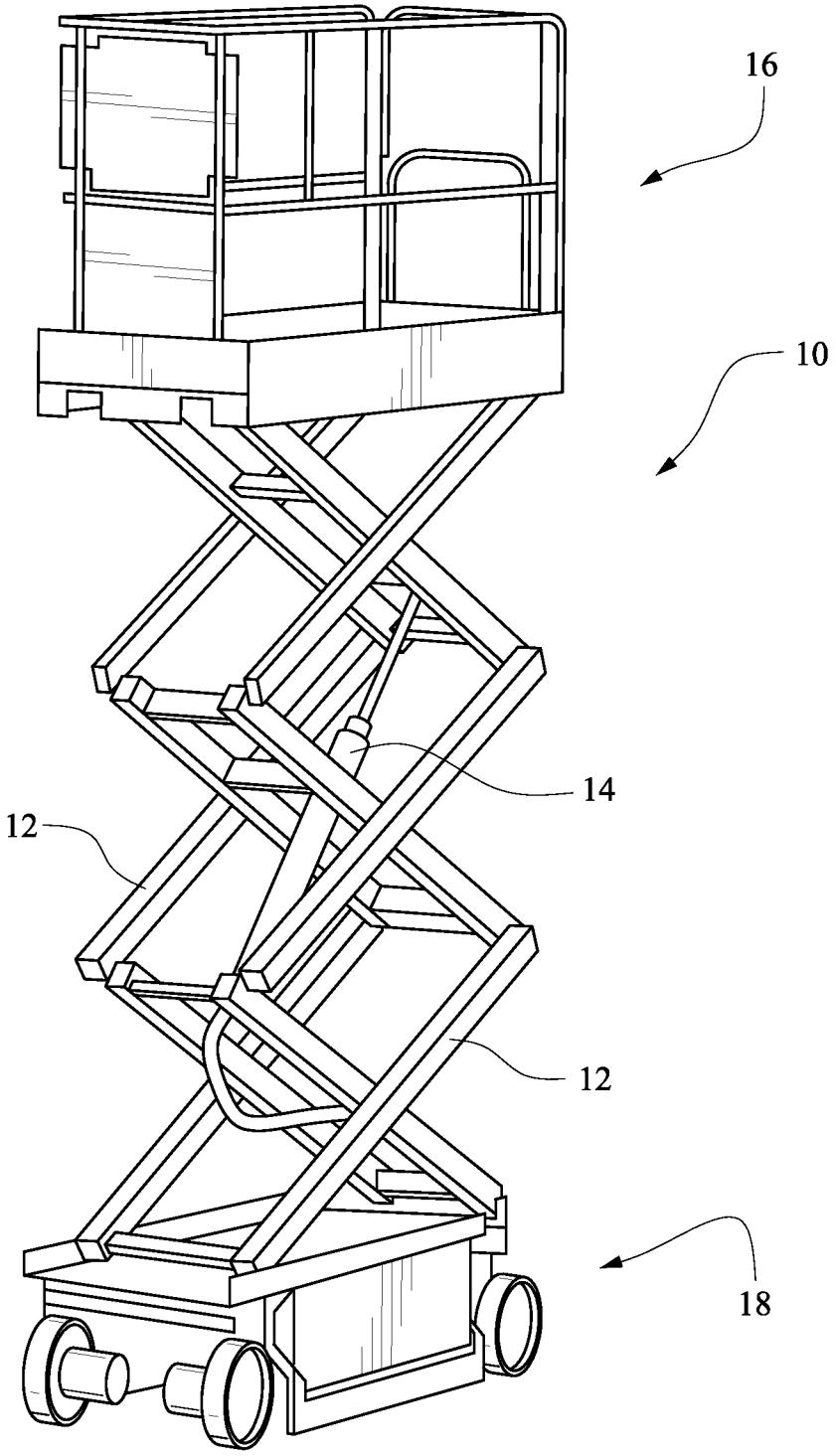
FIG. 1 is a perspective view of a scissor type aerial work platform.

FIG. 1 is a perspective view of a scissor lift 10 including a scissor arm assembly 12 displaceable between a raised position and a lowered position by a lift cylinder 14 such as a hydraulic lift cylinder or the like. The scissor arm assembly 12 includes a left side arm stack and a right side arm stack connected to each other across a middle area as shown. A platform 16 is supported by the scissor arm assembly 12. The scissor lift 10 also includes a base support 18 including wheels and driving structure. Scissor lift controls are accessible to an operator on the platform 16.

Figure 2:
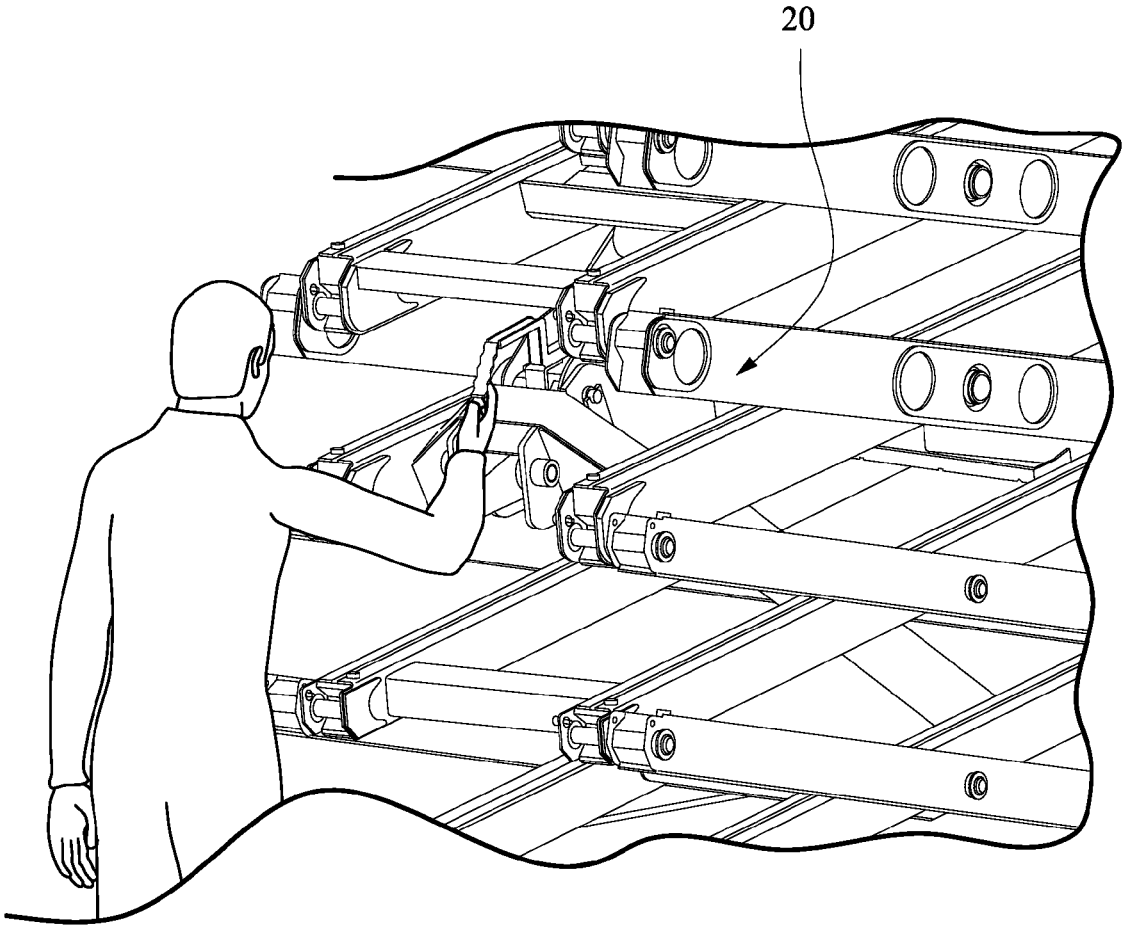
FIG. 2 shows a machine operator remotely engaging/disengaging the cylinder prop assembly while remaining clear of all pinch/crush hazards.

A cylinder prop assembly 20 acts between the scissor arm assembly 12 and the lift cylinder 14. As shown in FIG. 2, the cylinder prop assembly 20 is positioned in the middle area between the left side and right side arm stacks of the scissor arm assembly 12. In this position, an operator can safely and remotely engage and disengage the cylinder prop assembly 20.

Figure 3:
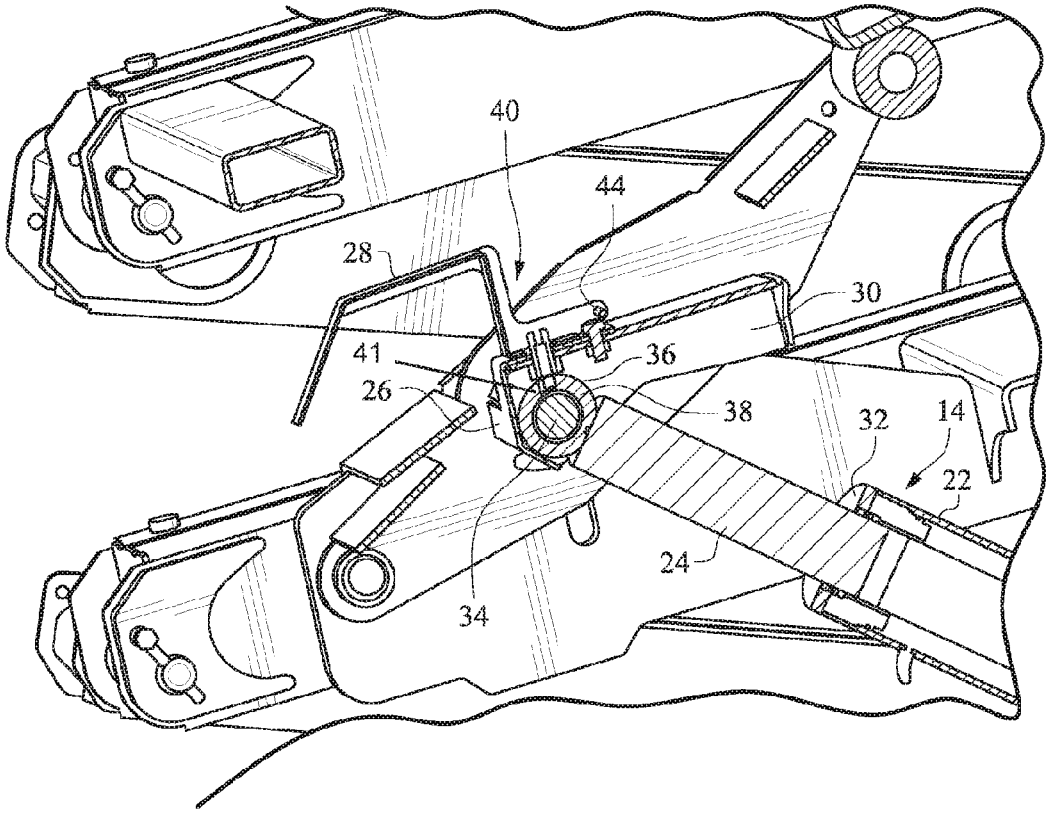
FIG. 3 is a cut-away view showing the cylinder prop assembly in a disengaged position.
Figure 4:
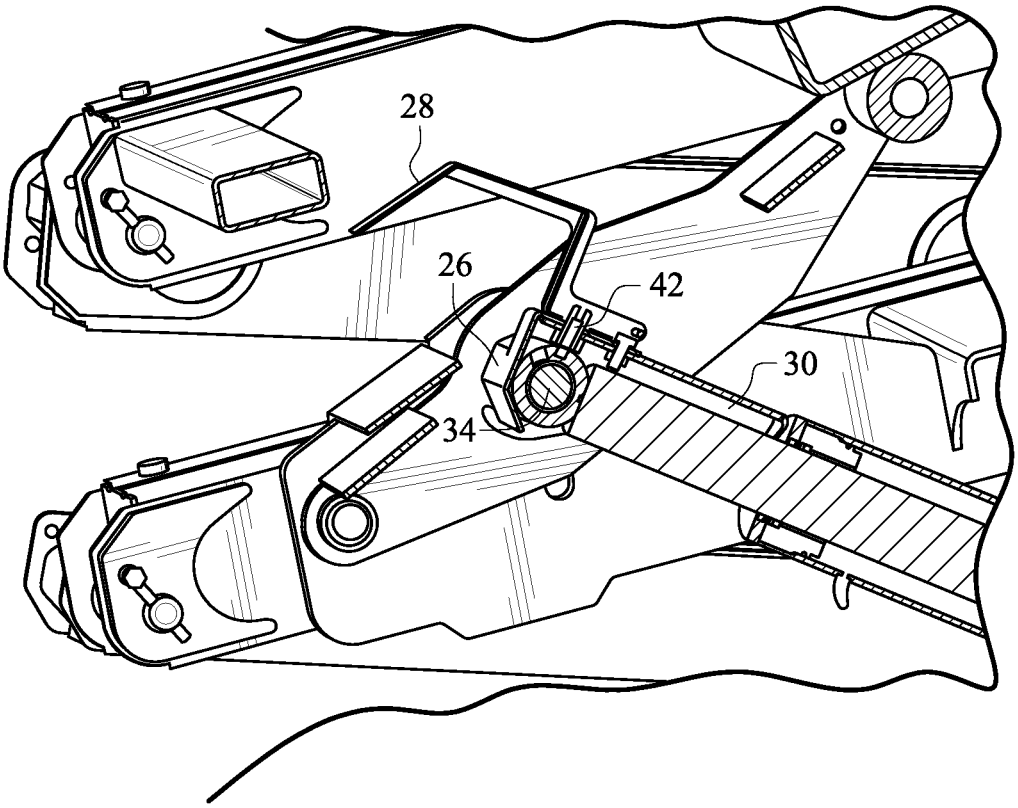
FIG. 4 is a cut-away view showing the cylinder prop assembly in an engaged position.

FIGS. 3 and 4 are cut-away views showing the cylinder prop assembly in a disengaged position and an engaged position, respectively. The lift cylinder 14 includes a housing 22 and a cylinder rod 24 displaceable relative to the housing 22 by hydraulic fluid. The cylinder prop assembly 20 serves to lock the cylinder rod 24 from displacement relative to the housing 22.

The cylinder prop assembly 20 includes a retaining plate 26 secured to a distal end of the cylinder rod 24 and pivotable relative to the cylinder rod 24. An actuation lever 28 is coupled with the retaining plate 26, and a cylinder prop 30 is coupled with the retaining plate and displaceable via the actuation lever 28 between the disengaged position (FIG. 3) and the engaged position (FIG. 4). The cylinder housing 22 defines a shoulder 32 relative to the cylinder rod 24. As shown in FIG. 4, in the engaged position, the cylinder prop 30 is disposed adjacent the shoulder 32. An opposite end of the cylinder prop 30 includes an axle 34 that is positionable and rotatable in an opening 36 in a bushing 38 at a distal end of the cylinder rod 24. A locking mechanism 40 is cooperable with a hole 41 in the bushing 38 to lock the cylinder prop 30 in the disengaged position. Preferably, the locking mechanism includes a spring-loaded plunger 42 engageable with the hole in the bushing 38. The spring loaded plunger 42 is disposed through the retaining plate 26 and connected to the actuation lever 28. The actuation lever 28 is pivotable relative to the retaining plate 26 at pivot 44 to retract the spring loaded plunger 42 as the cylinder prop 30 is displaced from its disengaged position to its engaged position via the actuation lever 28. Thus, the actuation lever 28 is cooperable with the locking mechanism 40 to selectively disengage the locking mechanism 40.

Components of the cylinder prop assembly are made of suitably strong materials such as steel or a material of similar strength and durability. The cylinder prop assembly provides a safe and effective mechanism for preventing inadvertent retraction of a scissor arm assembly during inspection and routine maintenance. The structure can be retrofit for existing machines and provides an effective solution for operator pinch/crush hazards.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A cylinder prop assembly acting between a cylinder rod and a cylinder housing, the cylinder prop assembly comprising:

a retaining plate securable to a distal end of the cylinder rod and pivotable relative to the cylinder rod;

an actuation lever coupled with the retaining plate; and a cylinder prop coupled with the retaining plate, wherein the cylinder prop is connected with the actuation lever via the retaining plate such that the cylinder prop is displaceable via operator engagement of the actuation lever between a disengaged position in which the cylinder rod is unlocked for displacement relative to the housing and an engaged position in which the cylinder rod is locked from displacement relative to the housing, wherein the actuation lever is pivotable relative to the retaining plate to pivot the retaining plate relative to the cylinder rod, wherein an end of the cylinder rod comprises a bushing having an opening therein, and wherein the cylinder prop includes an axle positionable and rotatable in the opening, the cylinder prop assembly further comprising a locking mechanism cooperable with the bushing to lock the cylinder prop in the disengaged position, wherein the locking mechanism comprises a spring-loaded plunger engageable with a hole in the bushing, wherein the spring-loaded plunger is disposed through the retaining plate and connected to the actuation lever, and wherein the actuation lever is pivotable relative to the retaining plate to retract the spring-loaded plunger.

2. A cylinder prop assembly according to claim 1, wherein the cylinder housing defines a shoulder relative to the cylinder rod, and wherein in the engaged position, the cylinder prop is disposed adjacent the shoulder.

3. A cylinder prop assembly cooperable with a lift cylinder for a scissor lift, wherein the lift cylinder includes a cylinder rod and a cylinder housing, the cylinder prop assembly comprising:

a cylinder prop displaceable between a disengaged position in which the cylinder rod is movable relative to the cylinder housing and an engaged position in which the cylinder rod is locked from displacement relative to the cylinder housing;

an actuation lever operatively coupled with the cylinder prop and accessible to displace the cylinder prop between the disengaged position and the engaged position;

a retaining plate pivotably secured to a distal end of the cylinder rod, wherein the actuation lever and the cylinder prop are connected to and movable with the retaining plate; and a locking mechanism that is constructed to lock the cylinder prop in the disengaged position, wherein the actuation lever is cooperable with the locking mechanism to selectively disengage the locking mechanism.

4. A cylinder prop assembly according to claim 3, wherein an end of the cylinder rod comprises a bushing having an opening therein, and wherein the cylinder prop includes an axle positioned in the opening and rotatable in the opening.

* * * * *